US007918266B2

(12) United States Patent
Arino et al.

(10) Patent No.: US 7,918,266 B2
(45) Date of Patent: Apr. 5, 2011

(54) HEAT EXCHANGER

(75) Inventors: Kouta Arino, Oyama (JP); Hideo Ohhashi, Oyama (JP)

(73) Assignee: Showa Denko K.K., Tokyo (JP)

( * ) Notice: Subject to any disclaimer, the term of this patent is extended or adjusted under 35 U.S.C. 154(b) by 866 days.

(21) Appl. No.: 11/909,223

(22) PCT Filed: Mar. 27, 2006

(86) PCT No.: PCT/JP2006/306993

§ 371 (c)(1),
(2), (4) Date: Sep. 20, 2007

(87) PCT Pub. No.: WO2006/104234

PCT Pub. Date: Oct. 5, 2006

(65) Prior Publication Data

US 2009/0056921 A1 Mar. 5, 2009

Related U.S. Application Data

(60) Provisional application No. 60/667,054, filed on Apr. 1, 2005.

(30) Foreign Application Priority Data

Mar. 29, 2005 (JP) ..... 2005-093925

(51) Int. Cl.
*F28F 9/02* (2006.01)

(52) U.S. Cl. ..... 165/78; 165/153

(58) Field of Classification Search ..... 165/78, 165/153, 178

See application file for complete search history.

(56) References Cited

U.S. PATENT DOCUMENTS

| | | | | |
|---|---|---|---|---|
| 5,069,275 | A * | 12/1991 | Suzuki et al. | 165/67 |
| 5,205,349 | A * | 4/1993 | Nagao et al. | 165/67 |
| 5,826,648 | A * | 10/1998 | Shimoya et al. | 165/153 |
| 7,303,003 | B2 | 12/2007 | Ohhashi et al. | |

(Continued)

FOREIGN PATENT DOCUMENTS

| | | | |
|---|---|---|---|
| JP | 2001133192 | A * | 5/2001 |
| JP | 2003-75024 | | 3/2003 |
| JP | 2003075024 | A * | 3/2003 |
| WO | 2004-081481 | | 9/2004 |

*Primary Examiner* — Allen J Flanigan
(74) *Attorney, Agent, or Firm* — Oblon, Spivak, McClelland, Maier & Neustadt, L.L.P.

(57) ABSTRACT

An evaporator 1 includes a refrigerant inlet header section 5 and a refrigerant outlet header section 6 which are arranged in the front-rear direction, a refrigerant circulation passage for establishing fluid communication between the header sections 5 and 6. First ends of the header sections 5 and 6 are closed with a first cap 19 and the second ends thereof are closed with a second cap 18. A refrigerant inlet 37 and a refrigerant outlet are formed in the first cap 19. A pipe joint member 21, having a refrigerant inflow port 45 communicating with the refrigerant inlet 37 and a refrigerant outflow port 46 communicating with the refrigerant outlet 38, is joined to the first cap 19. Mating concave portions 19*a* and 19*b* are formed on the first cap 19. Mating convex portions 21*a* and 21*b* which project toward the first cap 19 and which are to be fitted into the mating concave portions 19*a* and 19*b*, respectively, are formed on the pipe joint member 21. The second cap 18 has no mating concave portions into which the mating convex portions 21*a*, 21*b* are fitted. The evaporator (1) to which the heat exchanger of the present invention is applied can prevent erroneous attachment of the pipe joint member during manufacture thereof.

5 Claims, 13 Drawing Sheets

U.S. PATENT DOCUMENTS

2003/0221819 A1* 12/2003 Jang ..... 165/173
2004/0159121 A1* 8/2004 Horiuchi et al. ..... 62/526
2006/0207756 A1* 9/2006 Takayanagi et al. ..... 165/153
2007/0144721 A1 6/2007 Watanabe et al.

* cited by examiner

HEAT EXCHANGER

CROSS REFERENCE TO RELATED APPLICATIONS

This application is an application filed under 35 U.S.C. §111(*a*) claiming the benefit pursuant to 35 U.S.C. §119(*e*)(1) of the filing date of Provisional Application No. 60/667,054 filed Apr. 1, 2005 pursuant to 35 U.S.C. §111(*b*).

TECHNICAL FIELD

The present invention relates to a heat exchanger, and more particularly to a heat exchanger preferably used as an evaporator of a car air conditioner, which is a refrigeration cycle to be mounted on, for example, an automobile.

Herein and in the appended claims, a side represented by arrow X in FIGS. 1 and 11 is referred to as the "front," and the opposite side as the "rear." Herein and in the claims, the term "aluminum" encompasses aluminum alloys in addition to pure aluminum.

BACKGROUND ART

Conventionally, a so-called laminated evaporator has been widely employed as an evaporator for use in a car air conditioner. In the laminated evaporator, a plurality of flat, hollow members, each of which includes a pair of depressed plates facing each other and brazed to each other at their peripheral edge portions, are arranged in parallel, and corrugate fins having louvers are each disposed between and brazed to the adjacent flat, hollow members. However, in recent years, evaporators have been demanded to further reduce size and weight and to exhibit higher performance.

The present applicant proposed an evaporator which fulfills those requirements. The evaporator includes first and second header tanks separated from each other, and a heat exchange core section provided between these header tanks. The outer shapes of transverse cross sections of the header tanks are each symmetrical with respect to the front-rear direction. The interior of the first header tank is divided in the air flow direction by means of a partition wall so as to provide a refrigerant inlet header section located on the downstream side with respect to the air flow direction and a refrigerant outlet header section located on the upstream side with respect to the air flow direction. The interior of the refrigerant outlet header section is divided into upper and lower spaces by means of a flow-dividing resistance plate formed integrally with the refrigerant outlet header section, and a plurality of refrigerant passage holes are formed in the flow-dividing resistance plate. First ends of the refrigerant inlet header section and the refrigerant outlet header section are closed by a first cap joined to the two header sections while bridging them. Second ends of the refrigerant inlet header section and the refrigerant outlet header section are closed by a second cap which has the same shape as the first cap and is joined to the two header sections while bridging them. A refrigerant inlet is formed in a portion of the first cap which closes the refrigerant inlet header section, and a refrigerant outlet is formed in a portion of the first cap which closes the refrigerant outlet header section. A pipe joint member having a refrigerant inflow portion communicating with the refrigerant inlet and a refrigerant outflow portion communicating with the refrigerant outlet is joined to the first cap. The interior of the second header tank is divided in the air flow direction by means of a partition wall so as to provide a refrigerant inflow header section located on the downstream side with respect to the air flow direction and a refrigerant outflow header section located on the upstream side with respect to the air flow direction. These two header sections communicate with each other. The heat exchange core section is configured such that heat exchange tube groups are arranged in a plurality of rows in the air flow direction, each heat exchange tube group consisting of a plurality of heat exchange tubes arranged at predetermined intervals along the longitudinal direction of the header tanks. Opposite ends of heat exchange tubes of at least one heat exchange tube group are connected to the refrigerant inlet header section and the refrigerant inflow header section, and opposite ends of heat exchange tubes of the remaining heat exchange tube group(s) are connected to the refrigerant outlet header section and the refrigerant outflow header section (refer to Japanese Patent Application Laid-Open (kokai) No. 2003-75024; FIG. 15). This evaporator is manufactured through steps of assembling and provisionally joining the respective constituent members, and brazing all the constituent members together.

However, the outer transversal cross-section shape of the first header tank is symmetrical with respect to a center line in the front-rear direction, and the first and second caps are identical in shape. Therefore, when the respective constituent members are assembled for manufacture of the evaporator, the pipe joint member may be joined to the second cap in which the refrigerant inlet and the refrigerant outlet are not formed (erroneous assembly of the pipe joint member). In this case, no communication is established between the refrigerant inflow portion of the pipe joint member and the refrigerant inlet of the refrigerant inlet header section and between the refrigerant outflow portion of the pipe joint member and the refrigerant outlet of the refrigerant outlet header section, with the result that the assembled structure does not function as an evaporator. Moreover, the first cap having the refrigerant inlet and the refrigerant outlet, and the pipe joint member may be attached to the first end of the first header tank or the opposite or second end thereof depending on, for example, the vehicle model. In this case as well, since the outer transverse cross-section shape of the first header tank is symmetrical with respect to the front-rear direction, and the first and second caps are identical in shape, the pipe joint member may be joined to the second cap in which the refrigerant inlet and the refrigerant outlet are not formed (erroneous assembly of the pipe joint member), with the result that no communication is established between the refrigerant inflow portion of the pipe joint member and the refrigerant inlet of the refrigerant inlet header section and between the refrigerant outflow portion of the pipe joint member and the refrigerant outlet of the refrigerant outlet header section, and the assembled structure does not function as an evaporator.

An object of the present invention is to solve the above problem and to provide a heat exchanger which can prevent erroneous assembly of a pipe joint member at the time of manufacture of the heat exchanger.

DISCLOSURE OF THE INVENTION

To achieve the above object, the present invention comprises the following modes.

1) A heat exchanger comprising a refrigerant inlet header section and a refrigerant outlet header section which are arranged in parallel in a front-rear direction, and a refrigerant circulation passage for establishing communication between the header sections, wherein a refrigerant inlet is formed in the refrigerant inlet header section at a first end, and a refrigerant outlet is formed in the refrigerant outlet header section at the same end; and refrigerant having flowed from the refrigerant inlet into the refrigerant inlet header section returns to the refrigerant outlet header section after passing through the refrigerant circulation passage, and flows out of the refrigerant outlet, wherein the first ends of the refrigerant inlet header section and the refrigerant outlet header section are closed by a first cap joined to the two header sections while bridging them, and second ends of the refrigerant inlet header section and the refrigerant outlet header section are closed by a second cap joined to the two header sections while bridging them; the refrigerant inlet is formed in a portion of the first cap which closes the refrigerant inlet header section, and the refrigerant outlet is formed in a portion of the first cap which closes the refrigerant outlet header section; a pipe joint member having a refrigerant inflow portion communicating with the refrigerant inlet and a refrigerant outflow portion communicating with the refrigerant outlet is joined to the first cap; a mating concave portion is formed on the first cap, and a mating convex portion is formed on the pipe joint member such that the mating convex portion projects toward the first cap and is fitted into the mating concave portion; and the mating concave portion, into which the mating convex portion is fitted, is not formed on the second cap.

2) A heat exchanger according to par. 1), wherein the pipe joint member assumes a plate-like shape; and the first and second caps have the same outer shape, except for the mating concave portion.

3) A heat exchanger according to par. 1), wherein the mating concave portion is formed on the first cap at a position offset from the center thereof with respect to the front-rear direction.

4) A heat exchanger according to par. 1), wherein the mating concave portion comprises a cutout formed in a peripheral edge portion of the first cap.

5) A heat exchanger according to par. 1), wherein the refrigerant outlet header section is disposed on the rear side of the refrigerant inlet header section; the refrigerant circulation passage is formed by a refrigerant inflow intermediate header section disposed below the refrigerant inlet header section in opposition thereto, a refrigerant outflow intermediate header section disposed below the refrigerant outlet header section in opposition thereto, and a plurality of heat exchange tubes; the refrigerant inflow intermediate header section and the refrigerant outflow intermediate header section communicate with each other; at least one heat exchange tube group including a plurality of heat exchange tubes arranged at intervals along the longitudinal direction of the header sections is disposed between the refrigerant inlet header section and the refrigerant inflow intermediate header section and between the refrigerant outlet header section and the refrigerant outflow intermediate header section, whereby a heat exchanger core section is formed; and opposite end portions of the heat exchange tubes of the heat exchange tube group are connected to the opposed header sections.

In the heat exchanger of par. 1), a mating concave portion is formed on the first cap; a mating convex portion is formed on the pipe joint member such that the mating convex portion projects toward the first cap and fitted into the mating concave portion; and the mating concave portion, into which the mating convex portion is fitted, is not formed on the second cap. Therefore, if a worker attempts to attach the pipe joint member to the second cap during assembly of the respective constituent members for manufacture of the heat exchanger, the mating convex portion comes into engagement with the second cap to thereby prevent attachment of the pipe joint member to the second cap, whereby erroneous assembly of the pipe joint member can be prevented without fail. Accordingly, in this heat exchanger, communication can established without fail between the refrigerant inflow portion of the pipe joint member and the refrigerant inlet of the refrigerant inlet header section and between the refrigerant outflow portion of the pipe joint member and the refrigerant outlet of the refrigerant outlet header section, so that the assembled structure can be used as an evaporator without any problem.

Moreover, in the case where the first cap and the pipe joint member are attached to the first end of the first header tank or the opposite or second end thereof, the positions and/or sizes of the mating concave portion of the first cap to be attached to the first ends of the two header sections and the mating convex portion of the pipe joint member to be attached thereto can be made different from those of the mating concave portion of the first cap to be attached to the opposite or second ends of the refrigerant inlet and refrigerant outlet header sections and the mating convex portion of the pipe joint member to be attached thereto. In this case, during assembly of the respective constituent members for manufacture of the heat exchanger, the pipe joint member to be attached to the second end side is prevented from being attached to the first cap to be attached to the first end side, and the pipe joint member to be attached to the first end side is prevented from being attached to the first cap to be attached to the second end side. Consequently, erroneous assembly of the pipe joint member can be prevented without fail. Accordingly, in this heat exchanger, even when the end portion to which the first cap and the pipe joint member are attached is switched in accordance with needs, communication can be established without fail between the refrigerant inflow portion of the pipe joint member and the refrigerant inlet of the refrigerant inlet header section and between the refrigerant outflow portion of the pipe joint member and the refrigerant outlet of the refrigerant outlet header section, so that the assembled structure can be used as an evaporator without any problem.

In the heat exchanger of par. 2), since the pipe joint member assumes a plate-like shape, the thermal capacity of the pipe joint member becomes relatively low. Therefore, in the case where the pipe joint member is joined to the refrigerant inlet header section and the refrigerant outlet header section through, for example, brazing, the easiness of brazing is enhanced, and the work of manufacturing the entire heat exchanger becomes simple.

When the first and second caps have the same outer shape, except for the mating concave portion as in the heat exchanger of par. 2), during assembly of the respective constituent members for manufacture of the heat exchanger, the possibility of the pipe joint member being attached to the second cap may increase. However, even in such a case, the structure of par. 1) reliably prevents erroneous assembly of the pipe joint member.

In the heat exchanger of par. 4), the mating concave portion of the first cap can be formed in a relatively easy manner.

BEST MODE FOR CARRYING OUT THE INVENTION

Hereinafter, an embodiment of the present invention will next be described with reference to the drawings. In this embodiment, a heat exchanger according to the present invention is applied to an evaporator for a car air conditioner. Further, in the following description, the top, bottom, left and right of FIGS. 1, 2, and 11 will be referred to as "top" (or up, upper, or a similar expression), "bottom" (or down, lower, or a similar expression), "left" and "right", respectively.

Figure 1:
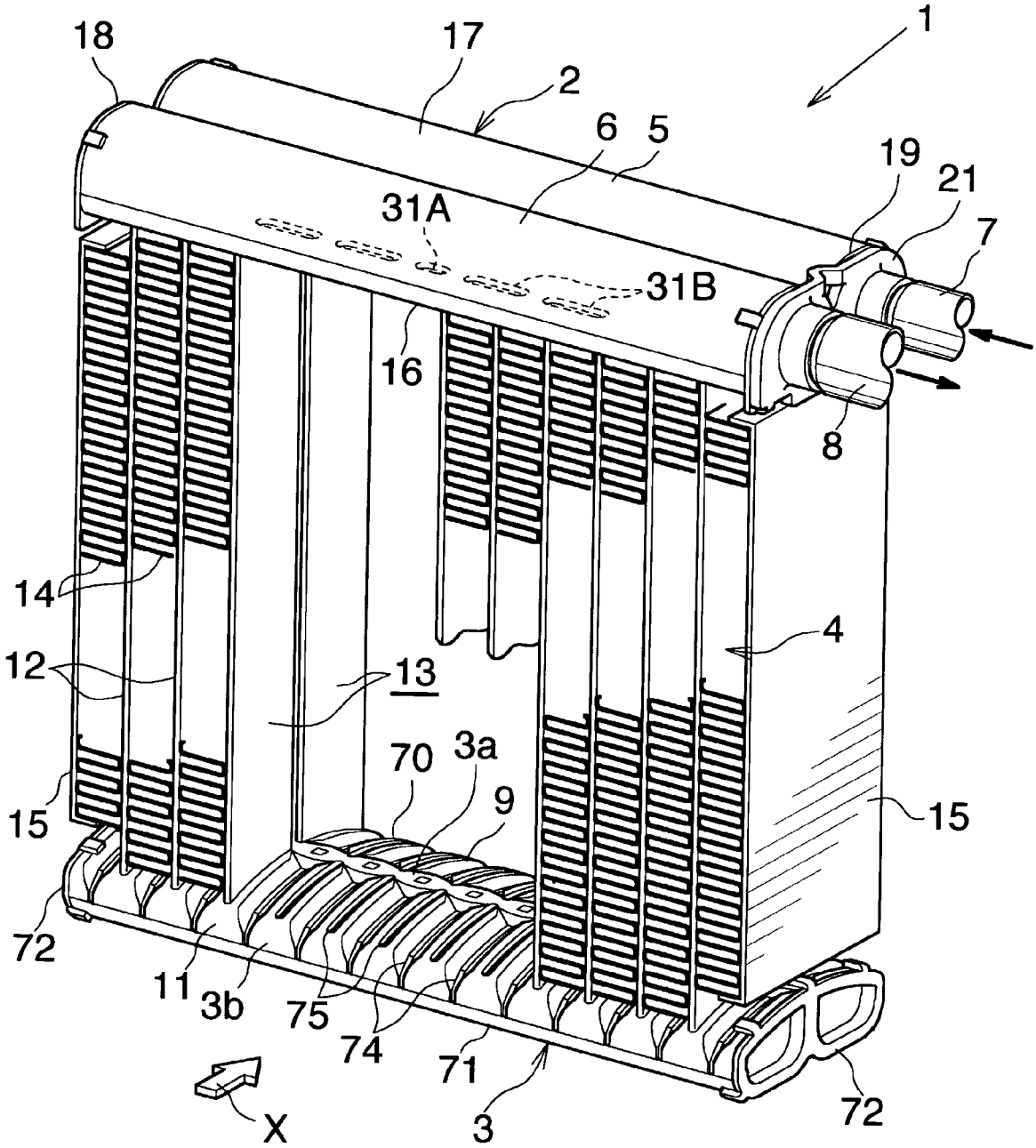
FIG. 1 is a partially cut-away perspective view showing the overall configuration of an evaporator to which a heat exchanger according to the present invention is applied.
Figure 2:
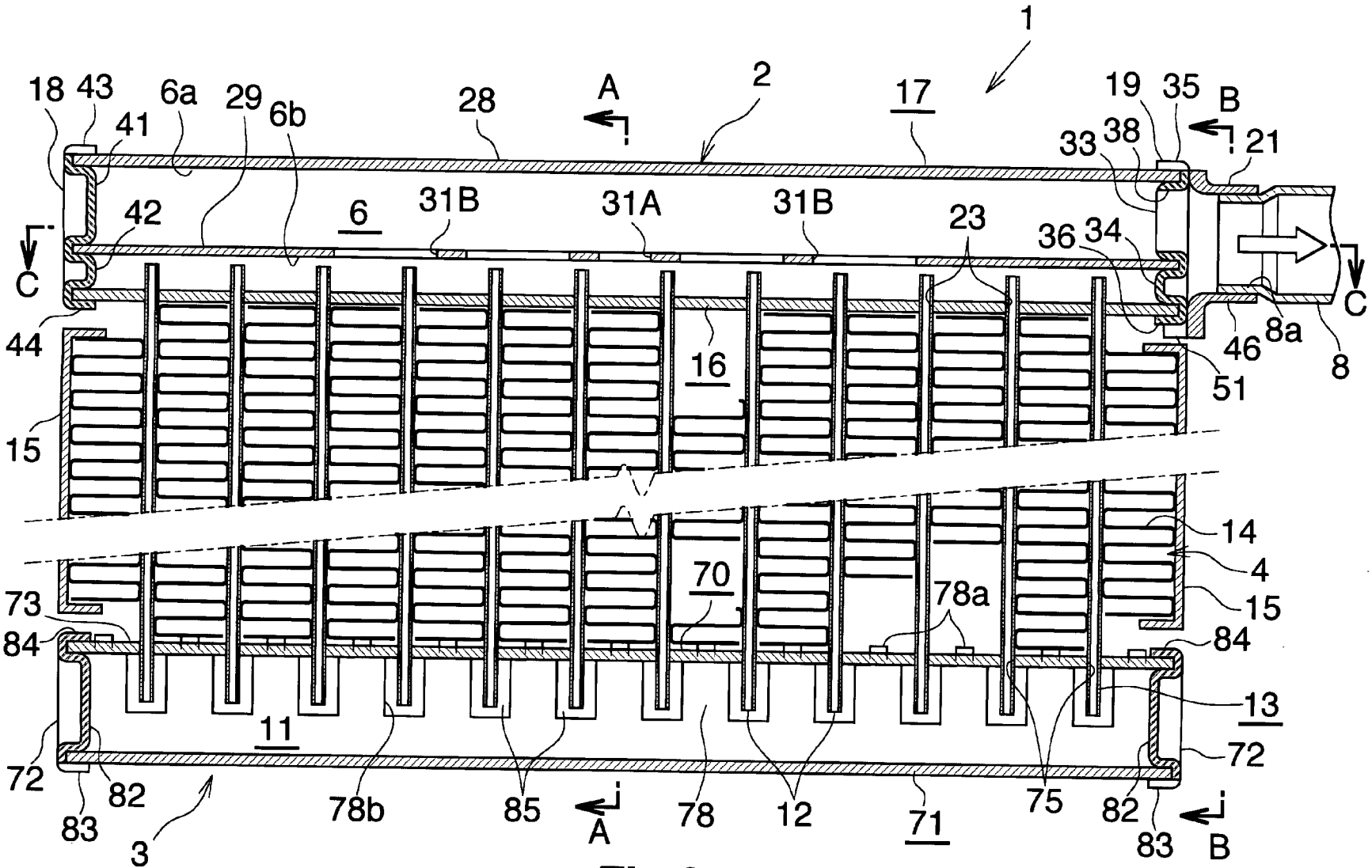
FIG. 2 is a fragmentary view in vertical section showing the evaporator of FIG. 1 with its intermediate portion omitted.
Figure 3:
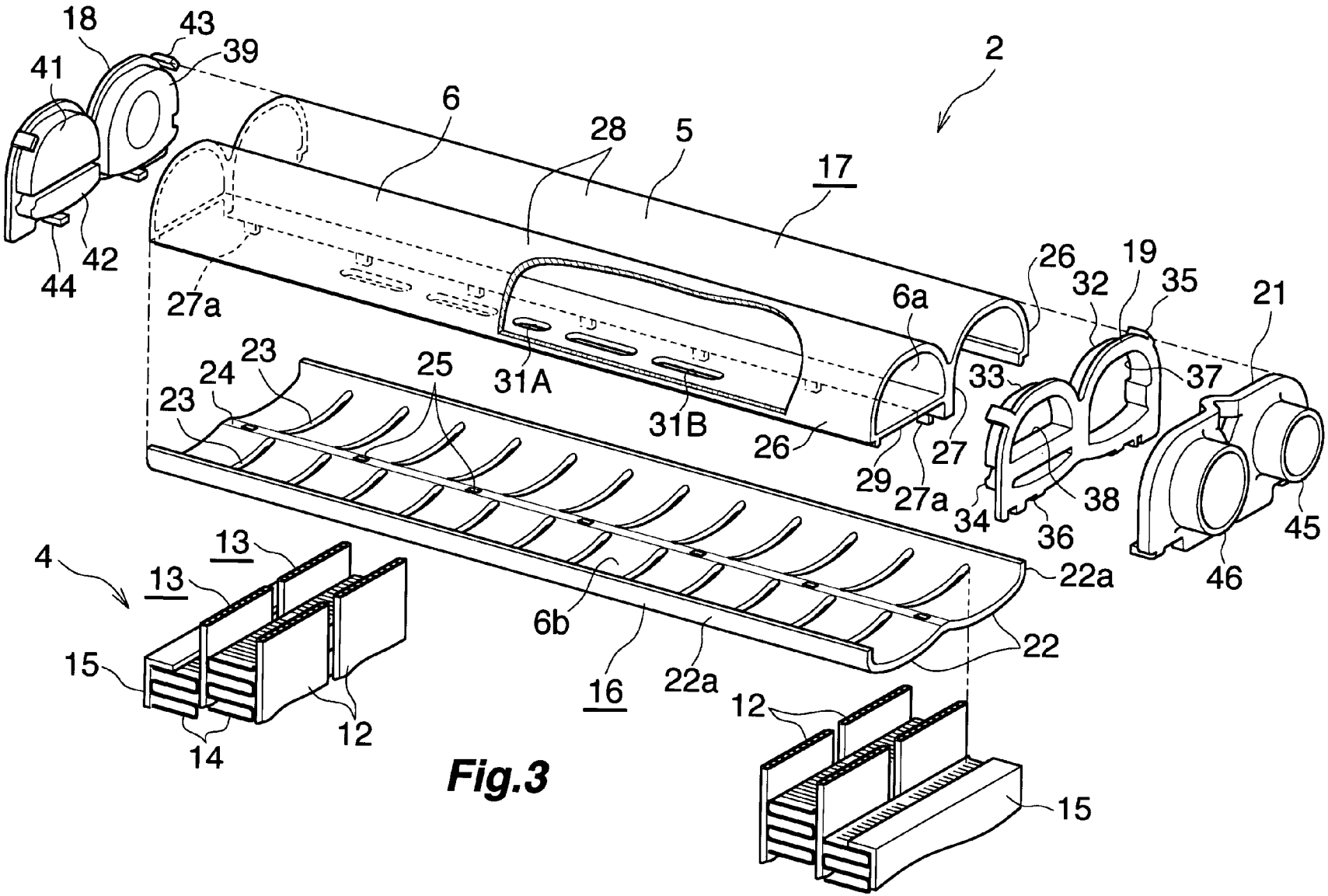
FIG. 3 is an exploded perspective view of a refrigerant inlet/outlet tank of the evaporator of FIG. 1.

FIGS. 1 and 2 show the overall configuration of an evaporator for a car air conditioner to which a heat exchanger of the present invention is applied. FIGS. 3 to 9 show the configuration of essential portions of the evaporator. FIG. 10 shows how a refrigerant flows in the evaporator.

In FIGS. 1 and 2, the evaporator (1), which is used in a car air conditioner using a chlorofluorocarbon-based refrigerant, includes a refrigerant inlet/outlet tank (2) made of aluminum and a refrigerant turn tank (3) made of aluminum, the tanks (2) and (3) being vertically spaced apart from each other, and further includes a heat exchange core section (4) provided between the tanks (2) and (3).

The refrigerant inlet/outlet tank (2) includes a refrigerant inlet header section (5) located on a side toward the front (downstream side with respect to the air flow direction) and a refrigerant outlet header section (6) located on a side toward the rear (upstream side with respect to the air flow direction). A refrigerant inlet pipe (7) made of aluminum is connected to the right end portion of the refrigerant inlet header section (5) of the refrigerant inlet/outlet tank (2). A refrigerant outlet pipe (8) made of aluminum is connected to the right end portion of the refrigerant outlet header section (6). The refrigerant turn tank (3) includes a refrigerant inflow header section (9) (refrigerant inflow intermediate header section) located on the side toward the front and a refrigerant outflow header section (11) (refrigerant outflow intermediate header section) located on the side toward the rear.

The heat exchange core section (4) is configured such that heat exchange tube groups (13) are arranged in a plurality of; herein, two, rows in the front-rear direction, each heat exchange tube group (13) consisting of a plurality of heat exchange tubes (12) arranged in parallel at predetermined intervals in the left-right direction. Corrugate fins (14) are disposed within corresponding air-passing clearances between the adjacent heat exchange tubes (12) of the heat exchange tube groups (13) and on the outer sides of the leftmost and rightmost heat exchange tubes (12) of the heat exchange tube groups (13), and are brazed to the corresponding heat exchange tubes (12). Side plates (15) made of aluminum are disposed on the outer sides of the leftmost and rightmost corrugate fins (14), and are brazed to the corresponding corrugate fins (14). The upper and lower ends of the heat exchange tubes (12) of the front heat exchange tube group (13) are connected to the refrigerant inlet header section (5) and the refrigerant inflow header section (9), respectively. The upper and lower ends of the heat exchange tubes (12) of the rear heat exchange tube group (13) are connected to the refrigerant outlet header section (6) and the refrigerant outflow header section (11), respectively. The refrigerant inflow header section (9), the refrigerant outflow header section (11), and all the heat exchange tubes (12) constitute a refrigerant circulation passage for establishing fluid communication between the refrigerant inlet header section (5) and the refrigerant outlet header section (6).

As shown in FIGS. 3 to 7, the refrigerant inlet/outlet tank (2) includes a plate-like first member (16) which is formed from an aluminum brazing sheet having a brazing material layer on each of opposite sides thereof and to which the heat exchange tubes (12) are connected; a second member (17) which is formed from a bare aluminum extrudate and covers the upper side of the first member (16); a first cap (19) which is formed from an aluminum brazing sheet having a brazing material layer on each of opposite sides thereof and which is joined to the right ends of the first and second members (16) and (17) to thereby close the right end openings of the refrigerant inlet header section (5) and the refrigerant outlet header section (6); and a second cap (18) which is formed from an aluminum brazing sheet having a brazing material layer on each of opposite sides thereof and which is joined to the left ends of the first and second members (16) and (17) to thereby close the left end openings of the refrigerant inlet header section (5) and the refrigerant outlet header section (6). A pipe joint member (21) made of aluminum, having a plate like shape, and elongated in the front-rear direction is joined to the outer surface of the first cap (19) while bridging the refrigerant inlet header section (5) and the refrigerant outlet header section (6). The refrigerant inlet pipe (7) and the refrigerant outlet pipe (8) are connected to the pipe joint member (21).

The first member (16) has front and rear curved portions (22), whose central regions each have an arcuate cross section projecting downward and having a small curvature. A plurality of tube insertion holes (23), which are elongated in the front-rear direction, are formed in the curved portions (22) at predetermined intervals in the left-right direction. The tube insertion holes (23) of the front curved portion (22) and those of the rear curved portion (22) are identical in position in the left-right direction. A rising wall (22*a*) is formed integrally with each of the front edge of the front curved portion (22) and the rear edge of the rear curved portion (22), over the entire length of the front and rear edges. A plurality of through holes (25) are formed in the flat portion (24) between the two curved portions (22) of the first member (16) at predetermined intervals in the left-right direction.

The second member (17) has a cross section resembling the letter m, which opens downward, and includes front and rear walls (26) extending in the left-right direction; a partition wall (27) (partitioning means) provided at a central region thereof between the front and rear walls (26), extending in the left-right direction, and dividing the interior of the refrigerant inlet/outlet tank (2) into a front space and a rear space; and two generally arcuate connection walls (28) projecting upward and integrally connecting the upper end of the partition wall (27) and the upper ends of the front and rear walls (26). A flow-dividing resistance plate (29) (dividing means) for dividing the interior of the refrigerant outlet header section (6) into an upper space (6*a*) and an lower space (6*b*), integrally connects a lower end portion of the rear wall (26) of the second member (17) and a lower end portion of the partition wall (27) over the entire length thereof. A plurality of refrigerant passage holes (31A) and (31B) in a through-hole form and elongated in the left-right direction are formed in a rear region, excluding left and right end portions thereof, of the flow-dividing resistance plate (29) at predetermined intervals in the left-right direction. The lower end of the partition wall (27) projects downward beyond the lower ends of the front and rear walls (26). A plurality of projections (27*a*) are integrally formed on the lower end face of the partition wall (27) at predetermined intervals in the left-right direction in such a manner as to project downward, and are fitted into corresponding through holes (25) of the first member (16). The projections (27*a*) are formed by cutting off predetermined portions of the partition wall (27).

Incidentally, the external shape of the assembly consisting of the first and second members (16) and (17) is symmetric with respect to a center line in the front-rear direction.

Figure 8:
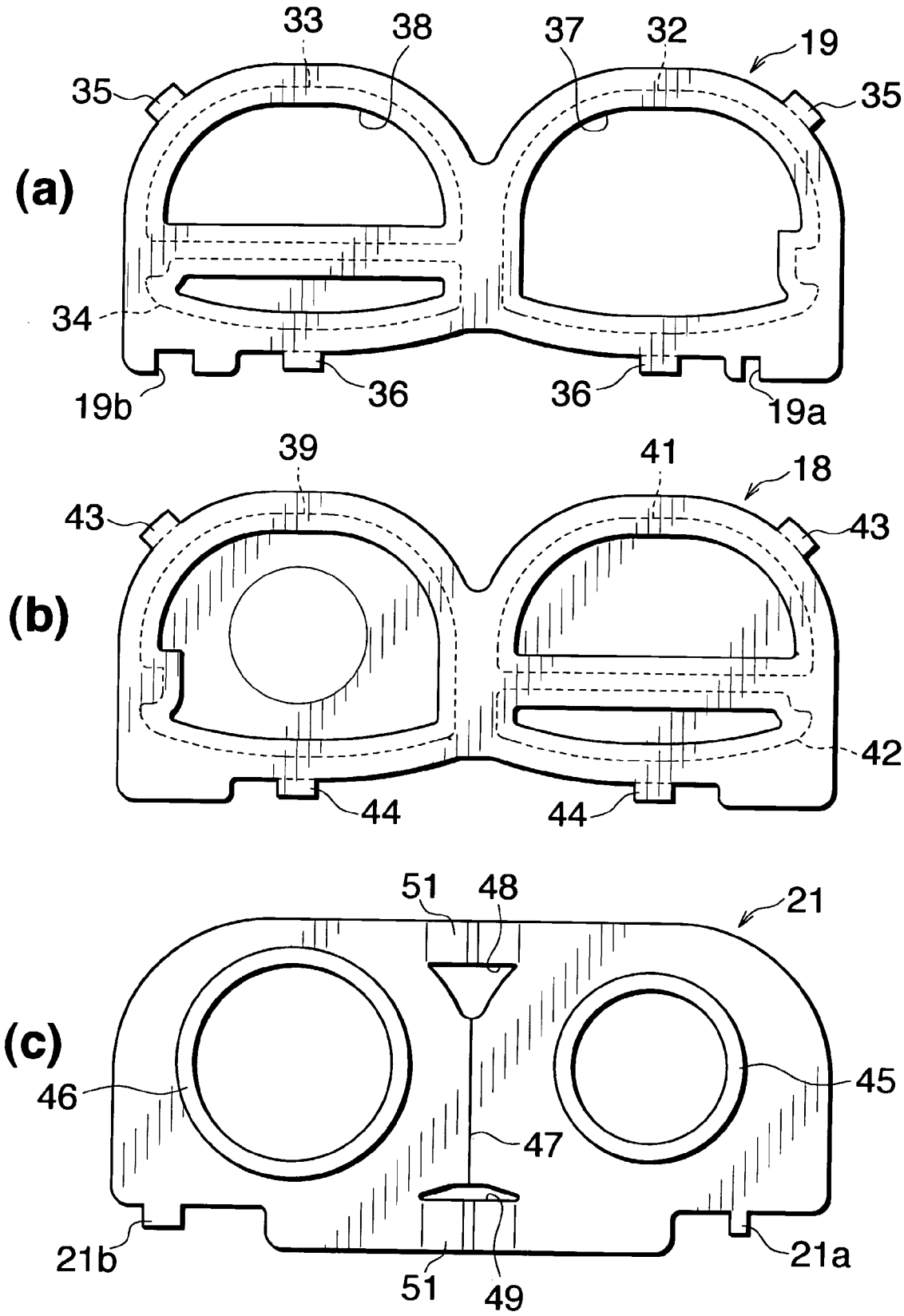
FIG. 8 is a front view showing the first and second caps and the pipe joint member of the evaporator of FIG. 1.

As shown in FIG. 8(*a*), a first inwardly-projecting portion (32) to be fitted into the refrigerant inlet header section (5) is integrally formed on a front portion of the first cap (19) which closes the refrigerant inlet header section (5). Similarly, a second inwardly-projecting portion (33) to be fitted into the upper space (6*a*) of the refrigerant outlet header section (6) located above the flow-dividing resistance plate (29), and a third inwardly-projecting portion (34) to be fitted into the lower space (6*b*) of the refrigerant outlet header section (6) located under the flow-dividing resistance plate (29) are integrally formed on a rear portion of the first cap (19) which closes the refrigerant outlet header section (6) such that the projecting portions (33) and (34) are separated from each other. Cutouts (19*a*) and (19*b*) (mating concave portions) are formed in a front end portion and a rear end portion of the lower edge portion of the first cap (19), respectively. The distance between the cutout (19*a*) and the center of the first cap (19) with the respect of the front-rear direction differs from the distance between the cutout (19*b*) and the center of the first cap (19) with the respect of the front-rear direction, and the size of the cutout (19*a*) differs from the size of the cutout (19*b*). An engagement finger (35) projecting leftward is formed integrally with each of an arcuate portion extending between the front side edge and the top edge of the first cap (19) and an arcuate portion extending between the rear side edge and the top edge of the first cap (19). Further, an engagement finger (36) projecting leftward is formed integrally with each of front and rear portions of the lower edge of the first cap (19). A refrigerant inlet (37) is formed in the projecting end wall of the first inwardly-projecting portion (32) of the first cap (19). A refrigerant outlet (38) is formed in the projecting end wall of the third inwardly-projecting portion (33) of the first cap (19).

As shown in FIG. 8(*b*), the second cap (18) has a shape which is identical with that of the first cap (19) except the cutouts (19*a*) and (19*b*) and which is a mirror image of the shape of the first cap (19) with respect to the left-right direction. The second cap (18) includes, in an integrated fashion, a first inwardly-projecting portion (39) to be fitted into the refrigerant inlet header section (5), a second inwardly-projecting portion (41) to be fitted into the upper space (6*a*) of the refrigerant outlet header section (6) located above the flow-dividing resistance plate (29), a third inwardly-projecting portion (42) to be fitted into the lower space (6*b*) of the refrigerant outlet header section (6) located under the flow-dividing resistance plate (29), and upper and lower engagement fingers (43) and (44) projecting rightward: The bottom walls of the first and second inwardly-projecting portions (39) and (41) have no opening formed thereon. Further, the lower edge portion of the second cap (18) has no cutout serving as a mating concave portion.

As shown in FIG. 8(*c*), the pipe joint member (21) includes a short, cylindrical refrigerant inflow port (45) (refrigerant inflow portion) communicating with the refrigerant inlet (37) of the first cap (19), and a short, cylindrical refrigerant outflow port (46) (refrigerant outflow portion) communicating with the refrigerant outlet (38) of the first cap (19). The center of the refrigerant inflow port (45) and the center of the refrigerant outflow port (46) are located at the same height. The outer diameter of the refrigerant inflow port (45) is smaller than the outer diameter of the refrigerant outflow port (46).

Mating convex portions (21*a*) and (21*b*) which project leftward and are to be fitted into the cutouts (19*a*) and (19*b*) of the first cap (19) are formed integrally with a front end portion and a rear end portion of the lower edge of the pipe joint member (21), respectively. The distance between the mating convex portion (21*a*) and the center of the pipe joint member (21) with respect to the front-rear direction differs from the distance between the mating convex portion (21*b*) and the center of the pipe joint member (21) with respect to the front-rear direction. The mating convex potion (21*a*) also differs in size from the mating convex portion (21*b*). A slit (47) extending in the vertical direction is formed on the pipe joint member (21) between the refrigerant inflow port (45) and the refrigerant outflow port (46). Through holes (48) and (49) are formed at the upper and lower ends of the slit (47), respectively, such that the through holes (48) and (49) are connected with the slit (47). Further, a portion of the pipe joint member (21) located above the upper through hole (48) and a portion of the pipe joint member (21) located under the lower through hole (49) are bent such that these portions project leftward to thereby from bent portions (51). These upper and lower bent portions (51) come into engagement with the refrigerant inlet header section (5) and the refrigerant outlet header section (6) at a location therebetween; i.e., the central portions of the two members (16) and (17) and the first cap (19) respect to the front-rear direction.

A diameter-reduced portion (7*a*) formed at one end portion of the refrigerant inlet pipe (7) is inserted into and brazed to the refrigerant inflow port (45) of the pipe joint member (21). Similarly, a diameter-reduced portion (8*a*) formed at one end portion of the refrigerant outlet pipe (8) is inserted into and brazed to the refrigerant outflow port (46) of the pipe joint member (21). However, the diameter-reduced portions (7*a*) and (8*a*) are not necessarily required to be formed at respective end portions of the refrigerant inlet pipe (7) and the refrigerant outlet pipe (8). Although unillustrated, an expansion valve attachment member is joined to the opposite end portions of the refrigerant inlet and outlet pipes (7) and (8) while bridging the pipes (7) and (8).

The first and second members (16) and (17) of the refrigerant inlet/outlet tank (2), the two caps (18) and (19), and the pipe joint member (21) are brazed together as follows. In assembly of the first and second members (16) and (17), the projections (27*a*) of the second member (17) are inserted into the corresponding through holes (25) of the first member (16), followed by crimping. As a result, upper end portions of the front and rear rising walls (22*a*) of the first member (16) come into engagement with the corresponding lower end portions of the front and rear walls (26) of the second member (17). In the thus-established condition, the first and second members (16) and (17) are brazed together by utilization of the brazing material layers of the first member (16). In attachment of the two caps (18) and (19), the first inwardly-projecting portions (39) and (32) are fitted into the front space of the first and second members (16) and (17) located forward of the partition wall (27), the second inwardly-projecting portions (41) and (33) are fitted into the rear upper space of the first and second members (16) and (17), the space being located backward of the partition wall (27) and above the flow-dividing resistance plate (29), the third inwardly-projecting portions (42) and (34) are fitted into the rear lower space of the first and second members (16) and (17), the space being located backward bf the partition wall (27) and under the flow-dividing resistance plate (29), the upper engagement fingers (43) and (35) are fitted to the connection walls (28) of the second member (17), and the lower engagement fingers (44) and (36) are fitted to the curved portions (22) of the first member (16). In the thus-established condition, the two caps (18) and (19) are brazed to the first and second members (16) and (17) by utilization of the brazing material layers thereof. The pipe joint member (21) is brazed to the first cap (19) by utilization of the brazing material layer thereof in the condition that the upper bent portion (51) is in engagement with the central portions of the first cap (19) and the second member (17) with respect to the front-rear direction, the lower bent portion (51) is in engagement with the central portions of the first cap (19) and the first member (16), and the mating convex portions (21*a*) and (21*b*) are fitted into the cutouts (19*a*) and (19*b*) formed in the lower edge of the first cap (19), respectively.

The refrigerant inlet/outlet tank (2) is thus formed. A portion of the refrigerant inlet/outlet tank (2) located forward of the flat portion (24) of the first member (16) and the partition wall (27) of the second member (17) serves as the refrigerant inlet header section (5). A portion of the refrigerant inlet/outlet tank (2) located backward of the flat portion (24) of the first member (16) and the partition wall (27) of the second member (17) serves as the refrigerant outlet header section (6). The refrigerant inlet header section (5) and the refrigerant outlet header section (6) are integrated with each other. The flow-dividing resistance plate (29) divides the refrigerant outlet header section (6) into the upper and lower spaces (6*a*) and (6*b*). The spaces (6*a*) and (6*b*) communicate with each other through the refrigerant passage holes (31A) and (31B). The refrigerant outlet (38) of the first cap (19) communicates with the upper space (6*a*) of the refrigerant outlet header section (6). The upper space (6*a*) is a first space which communicates with the refrigerant outlet (38), and the lower space (6*b*) is a second space which the heat exchange tubes (12) face. Further, the refrigerant inflow port (45) of the pipe joint member (21) communicates with the refrigerant inlet (37), and the refrigerant outflow port (46) communicates with the refrigerant outlet (38).

Figure 4:
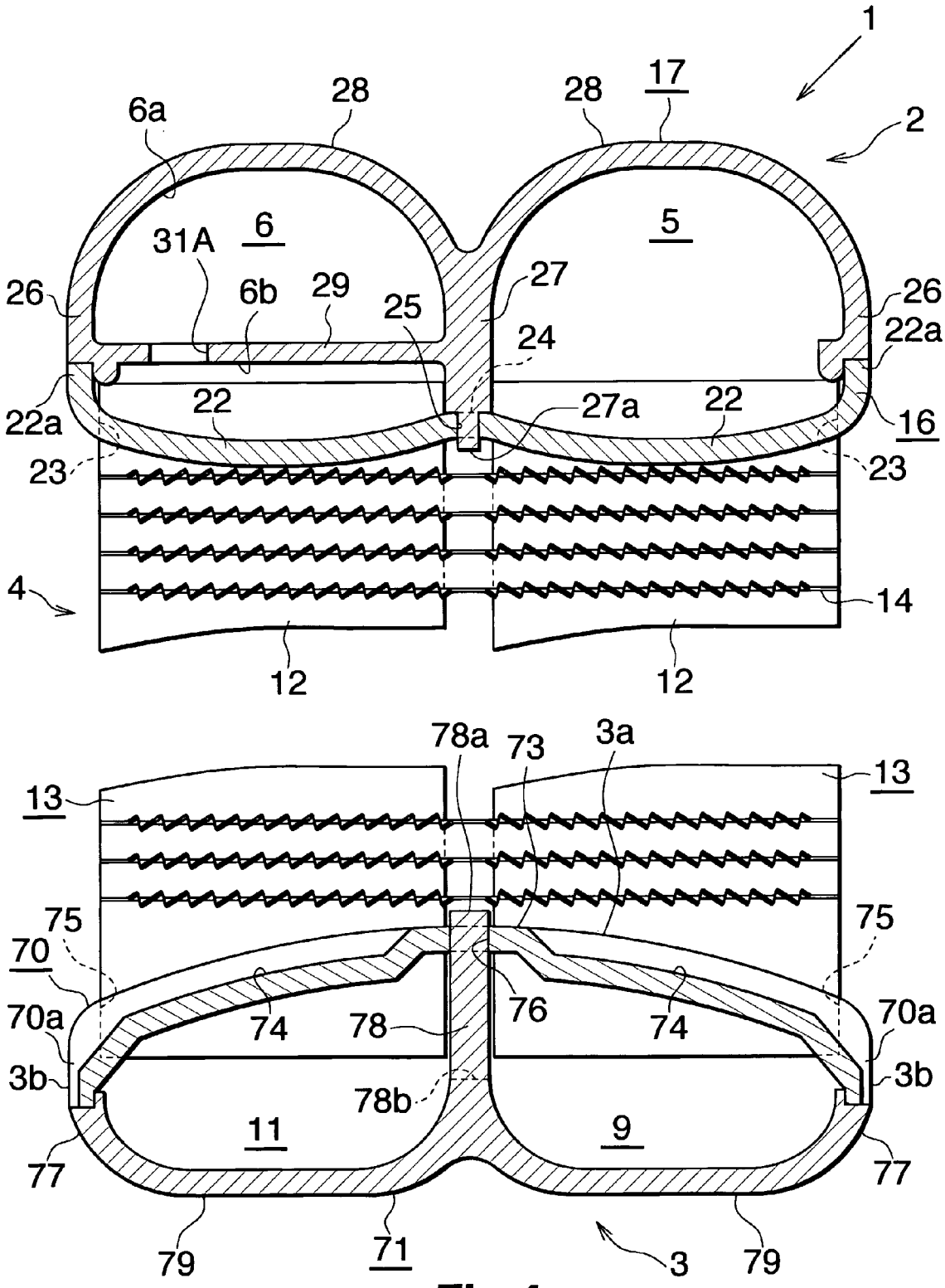
FIG. 4 is an enlarged fragmentary view in section taken along line A-A of FIG. 2.
Figure 5:
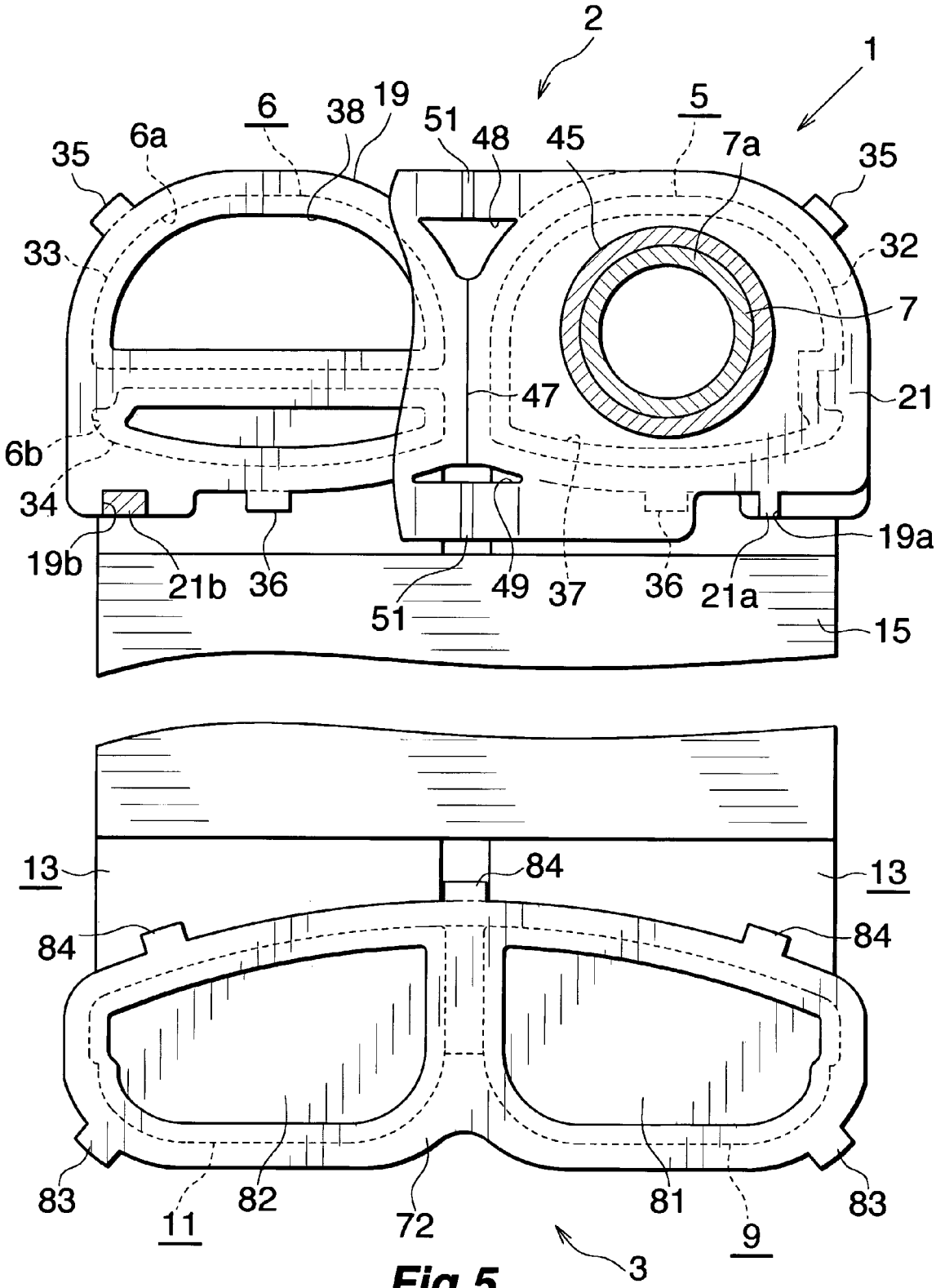
FIG. 5 is an enlarged fragmentary view in section taken along line B-B of FIG. 2.
Figure 6:
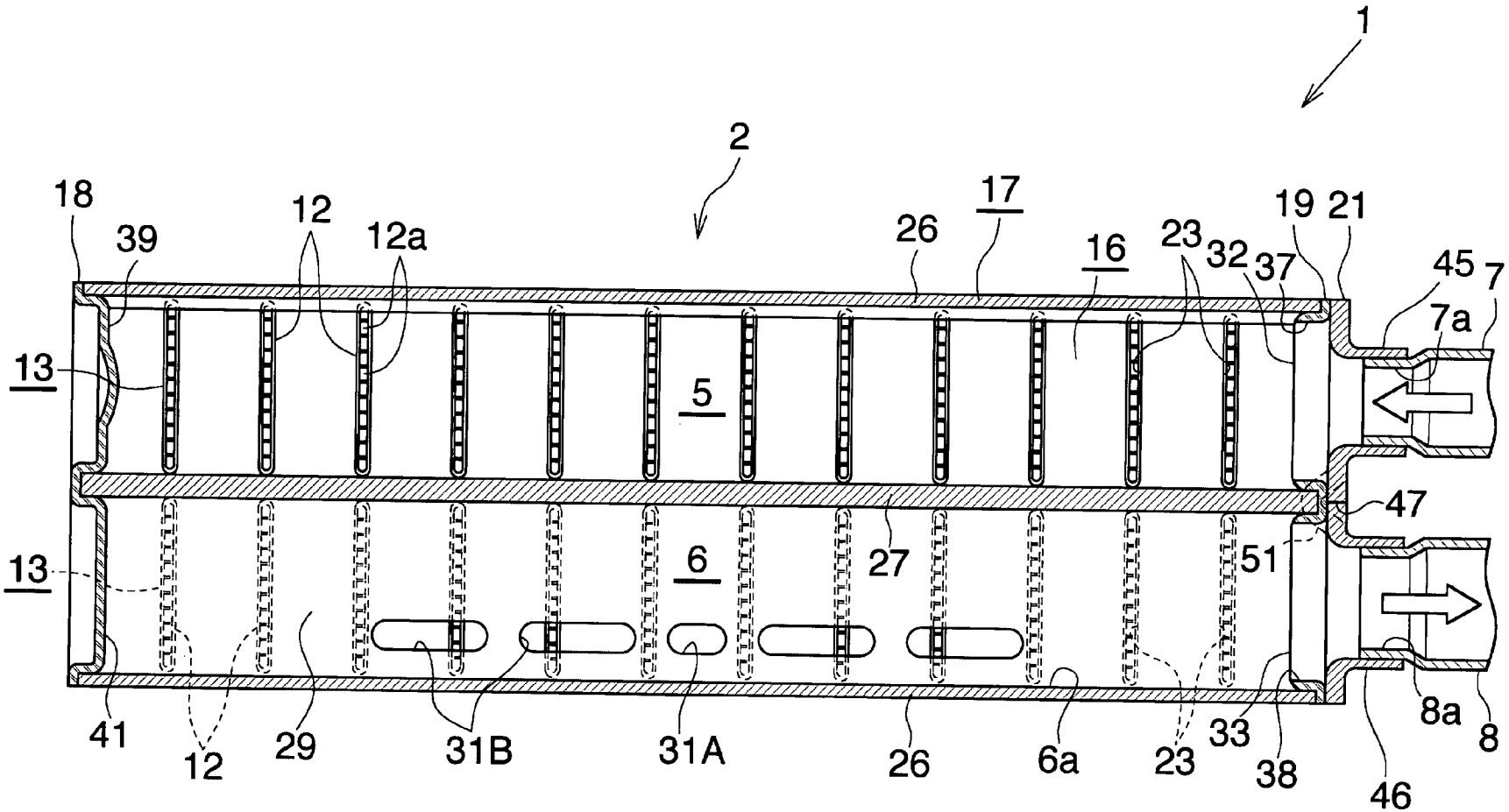
FIG. 6 is a sectional view taken along line C-C of FIG. 2.
Figure 7:
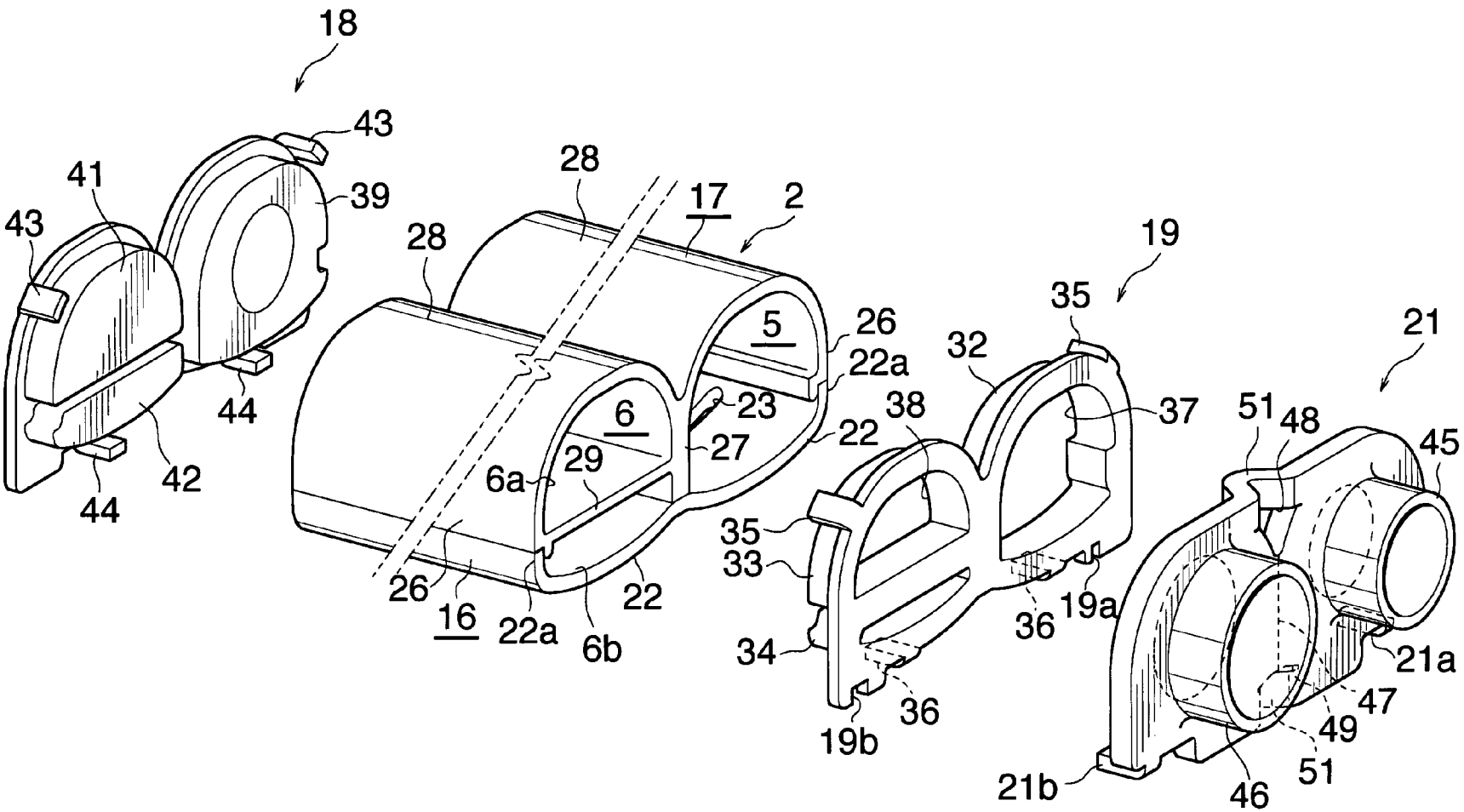
FIG. 7 is an exploded perspective view showing first and second members, first and second caps and a pipe joint member of the evaporator of FIG. 1 with a portion omitted.
Figure 9:
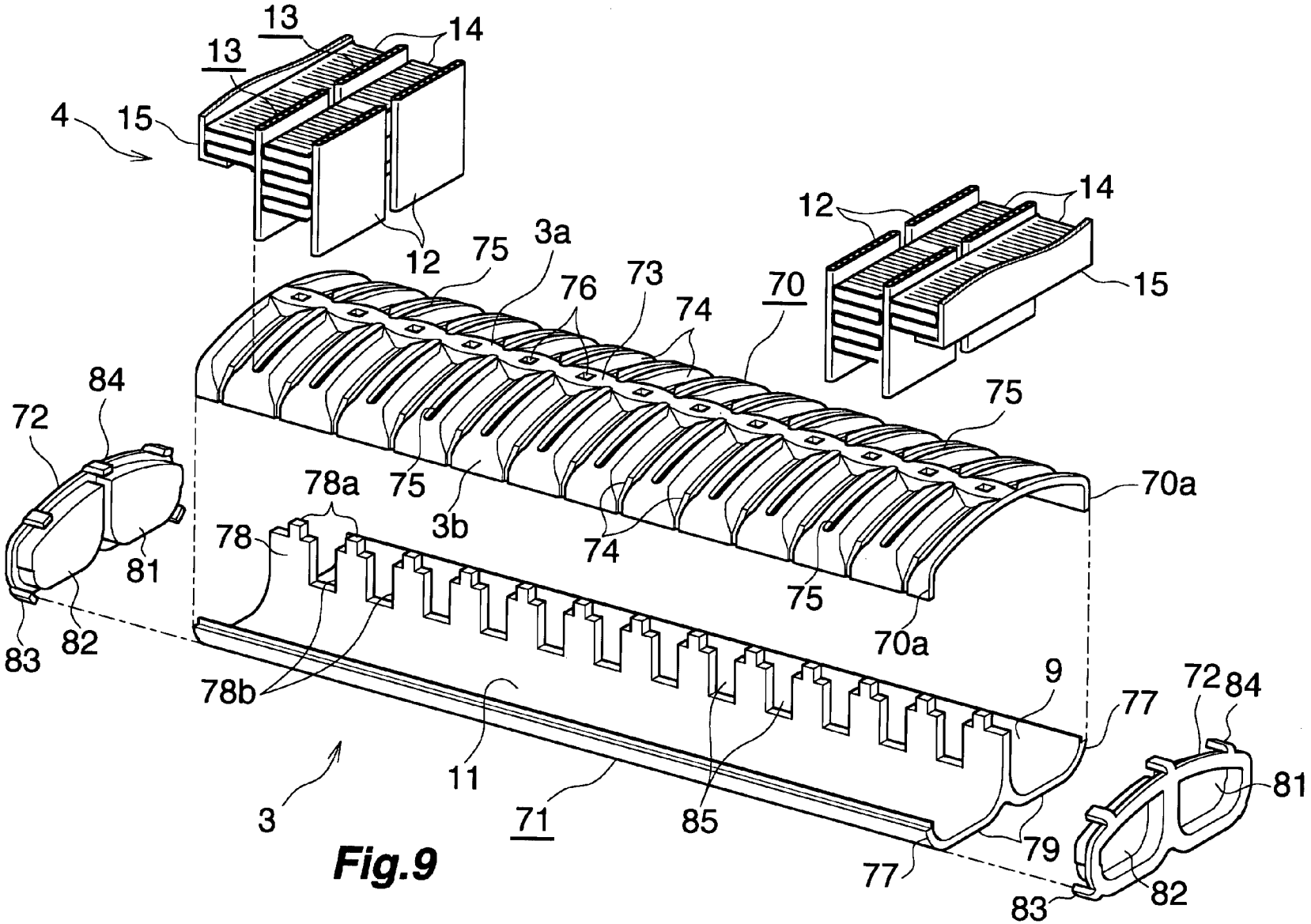
FIG. 9 is an exploded perspective view of a refrigerant turn tank of the evaporator of FIG. 1.
Figure 10:
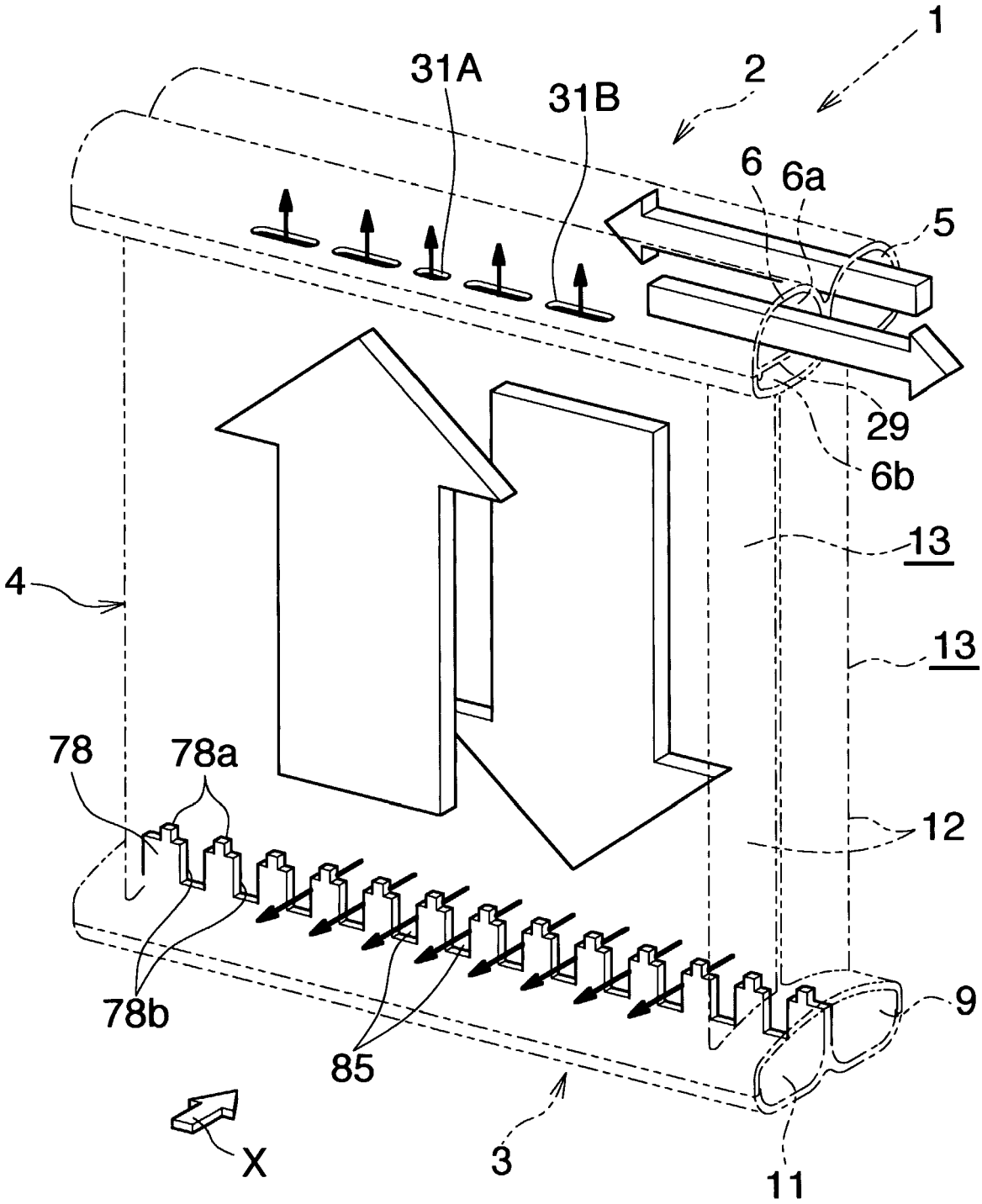
FIG. 10 is a diagram showing the flow of a refrigerant in the evaporator of FIG. 1.

As shown in FIGS. 4 and 9, the refrigerant turn tank (3) includes a plate-like first member (70).which is formed from an aluminum brazing sheet having a brazing material layer on each of opposite sides thereof and to which heat exchange tubes (12) are connected; a second member (71) which is formed from a bare aluminum extrudate and covers the lower side of the first member (70); and two cap (72) which are made of aluminum formed from an aluminum brazing sheet having a brazing material layer on each of opposite sides thereof and which close the left and right end openings, respectively.

A top face (3*a*) of the refrigerant turn tank (3) has such an arcuate transverse cross section that a central portion thereof with respect to the front-rear direction serves as a top portion (73) and that the height gradually decreases from the top portion (73) toward the front and rear sides. A plurality of grooves (74) are formed on front and rear portions of the refrigerant turn tank (3) at predetermined intervals along the left-right direction such that they extend from the front and rear sides of the top portion (73) of the top face (3*a*) to front and rear side surfaces (3*b*).

The first member (70) has an arcuate transverse cross section such that a central portion thereof with respect to the front-rear direction projects upward. Downwardly extending walls (70*a*) are formed integrally with front and rear edges of the first member (70) over the entire length thereof. The upper surface of the first member (70) serves as the top face (3*a*) of the refrigerant turn tank (3). The outer surfaces of the downwardly extending walls (70*a*) serve as the front and rear side surfaces (3*b*) of the refrigerant turn tank (3). The grooves (74) are formed on the front and rear portions of the first member (70) in such a manner as to extend from the top portion (73) at the center with respect to the front-rear direction to the lower ends of the downwardly extending walls (70*a*). Tube insertion holes (75) elongated in the front-rear direction are formed in the first member (70) excepting the top portion (73); i.e., in front and rear portions of the first member (70), such that the tube insertion holes (75)are located between the adjacent grooves (74). The front tube insertion holes (75) and the rear tube insertion holes (75) are identical in position in the left-right direction. A plurality of through holes (76) are formed in the top portion (73) of the first member (70) at predetermined intervals in the left-right direction.

The second member (71) has a transverse cross section resembling the letter w, which opens upward, and includes front and rear walls (77) curved upward and toward the outside with respect to the front-rear direction and extending in the left-right direction; a vertical partition wall (78) (partitioning means) provided at a central portion of the second member (71) between the front and rear walls (77), extending in the left-right direction, and dividing the interior of the refrigerant turn tank (3) into a front space and a rear space; and two connection walls (79) integrally connecting the lower ends of the front and rear walls (77) and the lower end of the partition wall (78). The upper end of the partition wall (78) projects upward beyond the upper ends of the front and rear walls (77). A plurality of projections (78*a*) projecting upward and to be fitted into the corresponding through holes (76) of the first member (70) are formed integrally with the upper end of the partition wall (78) at predetermined intervals in the left-right direction. Refrigerant passage cutouts (78*b*) are formed between the adjacent projections (78*a*) of the partition wall (78) in such a manner as to extend from its upper edges. The projections (78*a*) and the cutouts (78*b*) are formed by cutting out predetermined portions of the partition wall (78).

An inwardly-projecting portion (81) to be fitted into the refrigerant inflow header section (9) is integrally formed on a front portion of each cap (72) which closes the refrigerant inflow header section (9). Similarly, an inwardly-projecting portion (82) to be fitted into the refrigerant outflow header section (11) is integrally formed on a rear portion of each cap (72) which closes the refrigerant outflow header section (11). Moreover, engagement fingers (83) projecting inward in the left-right direction are formed integrally with each of an arcuate portion extending between the front side edge and the lower edge of each cap (72) and an arcuate portion extending between the rear side edge and the lower edge of the cap (72). Similarly, a plurality of engagement fingers (84) projecting inward in the left-right direction are formed integrally with the upper edge at predetermined intervals in the front-rear direction.

The first and second members (70) and (71) of the refrigerant return tank (3) and the two caps (72) are brazed together as follows. In assembly of the first and second members (70) and (71), the projections (78*a*) of the second member (71) are inserted into the corresponding through holes (76), followed by crimping. As a result, lower end portions of the front and rear downwardly extending walls (70*a*) of the first member (70) are fitted to corresponding upper end portions of the front and rear walls (77) of the second member (71). In the thus-established condition, the first and second members (70) and (71) are brazed together by utilization of the brazing material layers of the first member (70). In attachment of the two caps (72), the front inwardly-projecting portions (81) are fitted into the front space of the first and second members (70) and (71) located forward of the partition wall (78); the rear inwardly-projecting portions (82) are fitted into the rear space of the first and second members (70) and (71) located backward of the partition wall (78); the upper engagement fingers (84) are engaged with the first member (70); and lower engagement fingers (83) are engaged with the front and rear walls (77) of the second member (71). In the thus-established condition, the two caps (72) are brazed to the first and second members (70) and (71) by utilization of the brazing material layers of the caps (72). The refrigerant turn tank (3) is thus formed. A portion of the refrigerant turn tank (3) located forward of the partition wall (78) of the second member (71) serves as the refrigerant inflow header section (9). A portion of the refrigerant turn tank (3) located backward of the partition wall (78) serves as the refrigerant outflow header section (11). The upper end openings of cutouts (78*b*) of the partition wall (78) of the second member (71) are closed by the first member (70) to thereby form refrigerant passage holes (85).

Each of the heat exchange tubes (12) which constitute the front and rear heat exchange tube groups (13) is formed from an aluminum extrudate and assumes a flat form having a wide width in the front-rear direction. In the heat exchange tube (12), a plurality of refrigerant channels (12*a*) extending in the longitudinal direction thereof are formed in parallel therein (see FIG. 6). Upper end portions of the heat exchange tubes (12) are inserted into the corresponding tube insertion holes (23) of the first member (16) of the refrigerant inlet/outlet tank (2) and brazed to the first member (16) by utilization of the brazing material layers of the first member (16). Lower end portions of the heat exchange tubes (12) are inserted into the corresponding tube insertion holes (75) of the first member (70) of the refrigerant turn tank (3) and brazed to the first member (70) by utilization of the brazing material layers of the first member (70).

Preferably, the thickness of the heat exchange tube (12) as measured in the left-right direction; i.e., a tube height, is 0.75 mm to 1.5 mm; the width of the heat exchange tube (12) as measured in the front-rear direction is 12 mm to 18 mm; the wall thickness of the heat exchange tube (12) is 0.175 mm to 0.275 mm; the thickness of a partition wall separating the refrigerant channels from each other is 0.175 mm to 0.275 mm; the pitch of the partition walls is 0.5 mm to 3.0 mm; and the front and rear end walls each have a radius of curvature of 0.35 mm to 0.75 mm as measured on the outer surface thereof.

In place of use of the heat exchange tube (12) formed from an aluminum extrudate, a heat exchange tube to be used may be formed such that an inner fin is inserted into a seam welded pipe of aluminum so as to form a plurality of refrigerant channels therein. Alternatively, a heat exchange tube to be used may be formed as follows. An aluminum brazing sheet having a brazing material layer on one side thereof is subjected to a rolling process performed on the side where the brazing material is present, so as to form a plate that includes two flat-wall-forming portions connected together via a connection portion; side-wall-forming portions, which are formed, in a bulging condition, integrally with the corresponding flat-wall-forming portions at their side edges located in opposition to the connection portion; and a plurality of partition-wall-forming portions, which are formed integrally with the flat-wall-forming portions in such a manner as to project from the flat-wall-forming portions and to be arranged at predetermined intervals in the width direction of the flat-wall-forming portions. The thus-prepared plate is bent at the connection portion into a hairpin form such that the side-wall-forming portions abut each other, followed by brazing. The partition-wall-forming portions become partition walls.

Each of the corrugated fins (14) is made in a wavy form from an aluminum brazing sheet having a brazing material layer over opposite surfaces thereof. The corrugate fin (14) includes wave crest portions, wave trough portions, and connection portions each connecting together the wave crest portion and the wave trough portion. A plurality of louvers are formed at the connection portions in such a manner as to be juxtaposed in the front-rear direction. The front and rear heat exchange tube groups (13) share the corrugate fin (14). The width of the corrugate fin (14) as measured in the front-rear direction is approximately equal to the span between the front edges of the heat exchange tubes (12) of the front heat exchange group (13) and the rear edges of the rear heat exchange tubes (12) of the rear heat exchange tube group (13). The fin height of the corrugate fin (14) is a direct distance between the wave crest portion and the wave through portion, and is preferably 7.0 mm to 10.0 mm. The fin pitch of the corrugate fin (14) is half the distance between the centers (in the vertical direction) of adjacent wave crest portions or wave through portions, and is preferably 1.3 mm to 1.8 mm. Instead of a single corrugate fin being shared between the front and rear heat exchange tube groups (13), a corrugate fin may be disposed between the adjacent heat exchange tubes (12) of each of the front and rear heat exchange tube groups (13).

In manufacture of the evaporator (1), constituent members thereof excluding the refrigerant inlet pipe (7) and the refrigerant outlet pipe (8) are assembled and provisionally fixed together, and then all the constituent members are brazed together. The first cap (19) of the refrigerant inlet/outlet tank (2) has the cutouts (19*a*) and (19*b*) formed therein, and the pipe joint member (21) has the mating convex portions (21*a*) and (21*b*) projecting toward the first cap (19) and fitted into the cutouts (19*a*) and (19*b*), respectively. In contrast, the second cap (18) has no cutout serving as a mating concave portion into which the mating convex portions (21*a*) and (21*b*) are fitted. Consequently, during assembly of the constituent members for manufacture of the evaporator (1), if a worker attempts to attach the pipe joint member (21) to the second cap (18), the mating convex portions (21*a*) and (21*b*) come into engagement with the second cap (18). Therefore, the pipe joint member (21) cannot be combined with the second cap (18). Such configuration can prevent erroneous assembly of the pipe joint member (21).

The evaporator (1), together with a compressor and a condenser, constitutes a refrigeration cycle which is installed in a vehicle, such as an automobile, as a car air conditioner.

In the evaporator (1) described above, as shown in FIG. 10, two-layer refrigerant of vapor-liquid phase having passed through a compressor, a condenser, and an expansion valve enters the refrigerant inlet header section (5) of the refrigerant inlet/outlet tank (2) from the refrigerant inlet pipe (7) through the refrigerant inflow port (45) of the pipe joint member (21) and the refrigerant inlet (37) of the first cap (19). Then, the refrigerant dividedly flows into the refrigerant channels (12*a*) of all the heat exchange tubes (12) of the front heat exchange tube group (13). At this time, since the refrigerant inlet pipe (7) has the diameter-reduced portion (7*a*), the refrigerant easily reaches the left end portion of the refrigerant inlet header section (5), and uniformly flows into all of the heat exchange tubes (12) of the front heat exchange group (13).

The refrigerant having entered the refrigerant channels (12*a*) of all the heat exchange tubes (12) flows downward through the refrigerant channels (12*a*) and enters the refrigerant inflow header section (9) of the refrigerant turn tank (3). The refrigerant having entered the refrigerant inflow header section (9) passes through the refrigerant passage holes (85) of the partition wall (78) and enters the refrigerant outflow header section (11).

The refrigerant having entered the refrigerant outflow header section (11) dividedly flows into the refrigerant cannels (12*a*) of all the heat exchange tubes (12) of the rear heat exchange tube group (13); flows upward, in opposition to the previous flow direction, through the refrigerant channels (12*a*); and enters the lower space (6*b*) of the refrigerant outlet header section (6). Since the flow-dividing resistance plate (29) imparts resistance to the flow of the refrigerant, the divided flow from the refrigerant outflow header section (11) to all the heat exchange tubes (12) of the rear heat exchange tube group (13) becomes uniform, and the divided flow from the refrigerant inlet header section (5) to all the heat exchange tubes (12) of the front heat exchange tube group (13) becomes uniform to a greater extent. As a result, the refrigerant flow rate becomes uniform among all the heat exchange tubes (12) of the two heat exchange tube groups (13).

Then, the refrigerant passes through the refrigerant passage holes (31A) and (31B) of the flow-dividing resistance plate (29) and enters the upper space (6*a*) of the refrigerant outlet header section (6). Subsequently, the refrigerant flows out to the refrigerant outlet pipe (8) through the refrigerant outlet (38) of the first cap (19) and the refrigerant outflow port (46) of the pipe joint member (21). While flowing through the refrigerant channels (12*a*) of the heat exchange tubes (12) of the front heat exchange tube group (13) and through the refrigerant channels (12*a*) of the heat exchange tubes (12) of the rear heat exchange tube group (13), the refrigerant is subjected to heat exchange with the air flowing through the air-passing clearances in the direction of arrow X shown in FIGS. 1 and 10 flows out from the evaporator (1) in a vapor phase.

During the heat exchange, condensed water is generated on the surface of the corrugate fins (14). The condensed water flows downward onto the top face (3*a*) of the refrigerant turn tank (3). Then, the condensed water, by the capillary effect, enters the grooves (74); flows through the grooves (74); and drops downward below the refrigerant turn tank (3) from front and rear end portions of the grooves (74). This mechanism prevents freezing of condensed water which could otherwise result from stagnation of condensed water in a large amount in the region between the top face (3*a*) of the refrigerant turn tank (3) and the lower ends of the corrugate fins (14). As a result, a drop in performance of the evaporator (1) is prevented.

Figure 11:
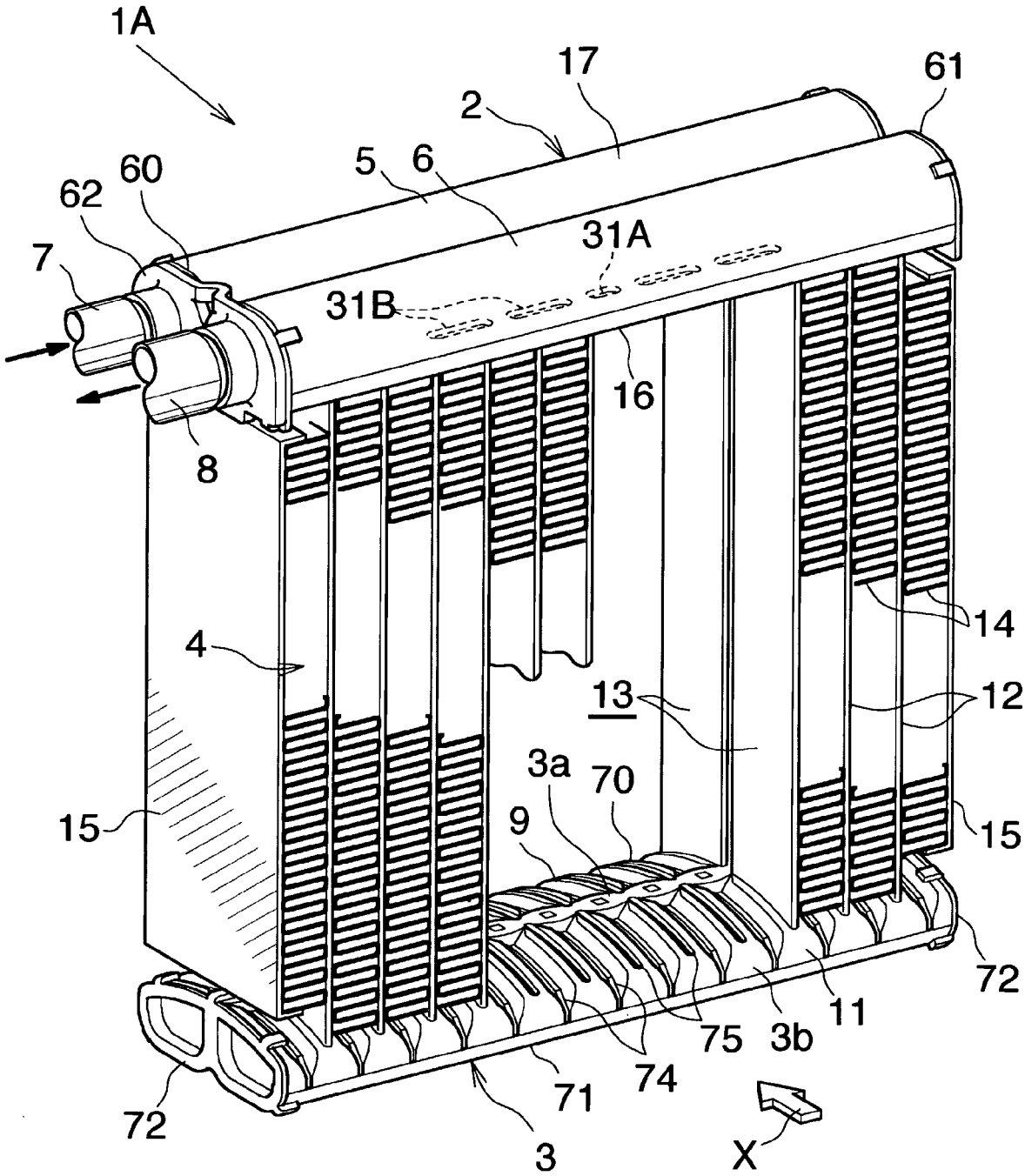
FIG. 11 is a partially cut-away perspective view showing an evaporator in which a refrigerant inlet pipe and a refrigerant outlet pipe are connected to the ends, which are opposite to those in the evaporator of FIG. 1, of a refrigerant inlet header section and a refrigerant outlet header section of a refrigerant inlet/outlet tank.
Figure 12:
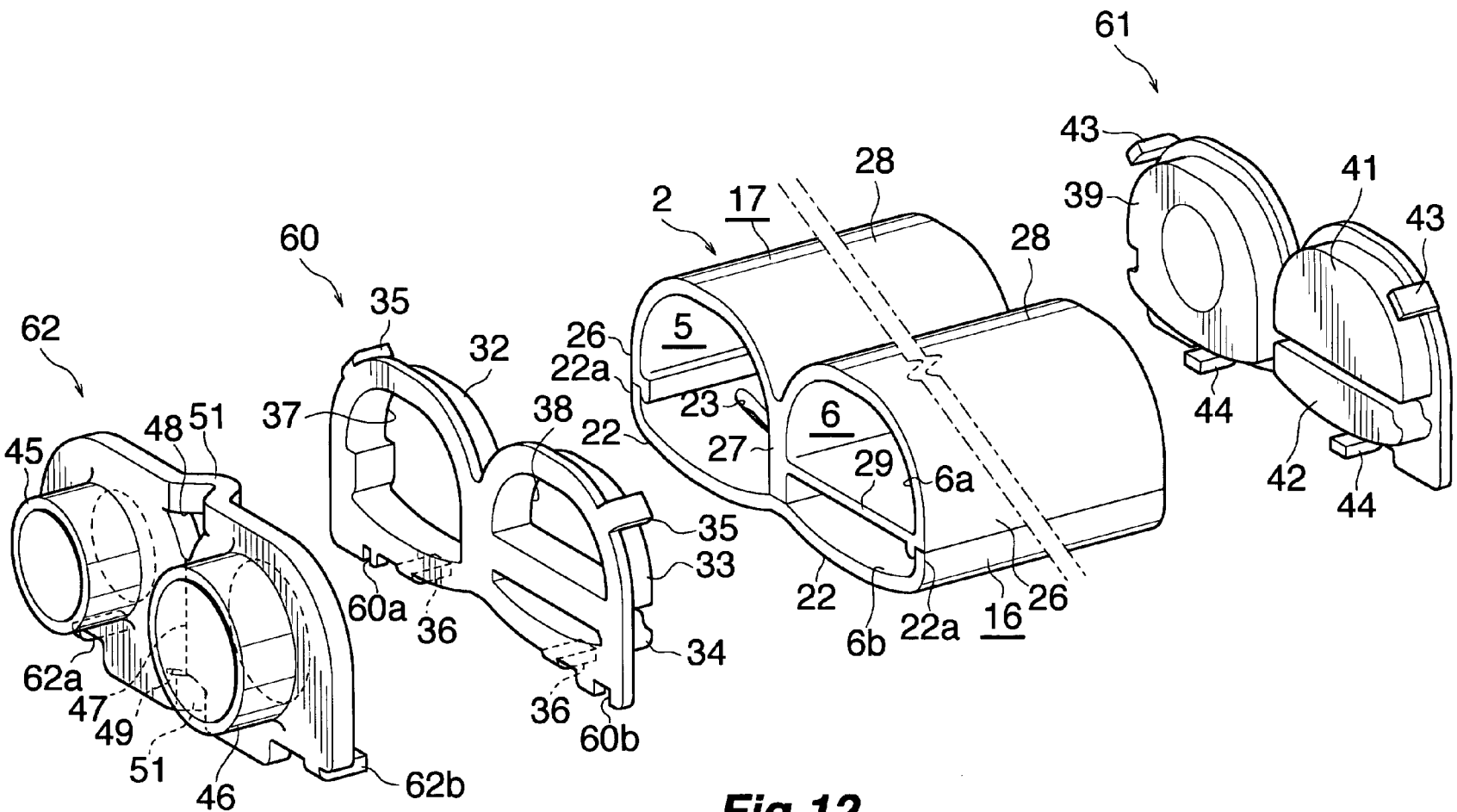
FIG. 12 is an exploded perspective view showing first and second members, first and second caps and a pipe joint member of an evaporator of FIG. 11 with a portion omitted.
Figure 13:
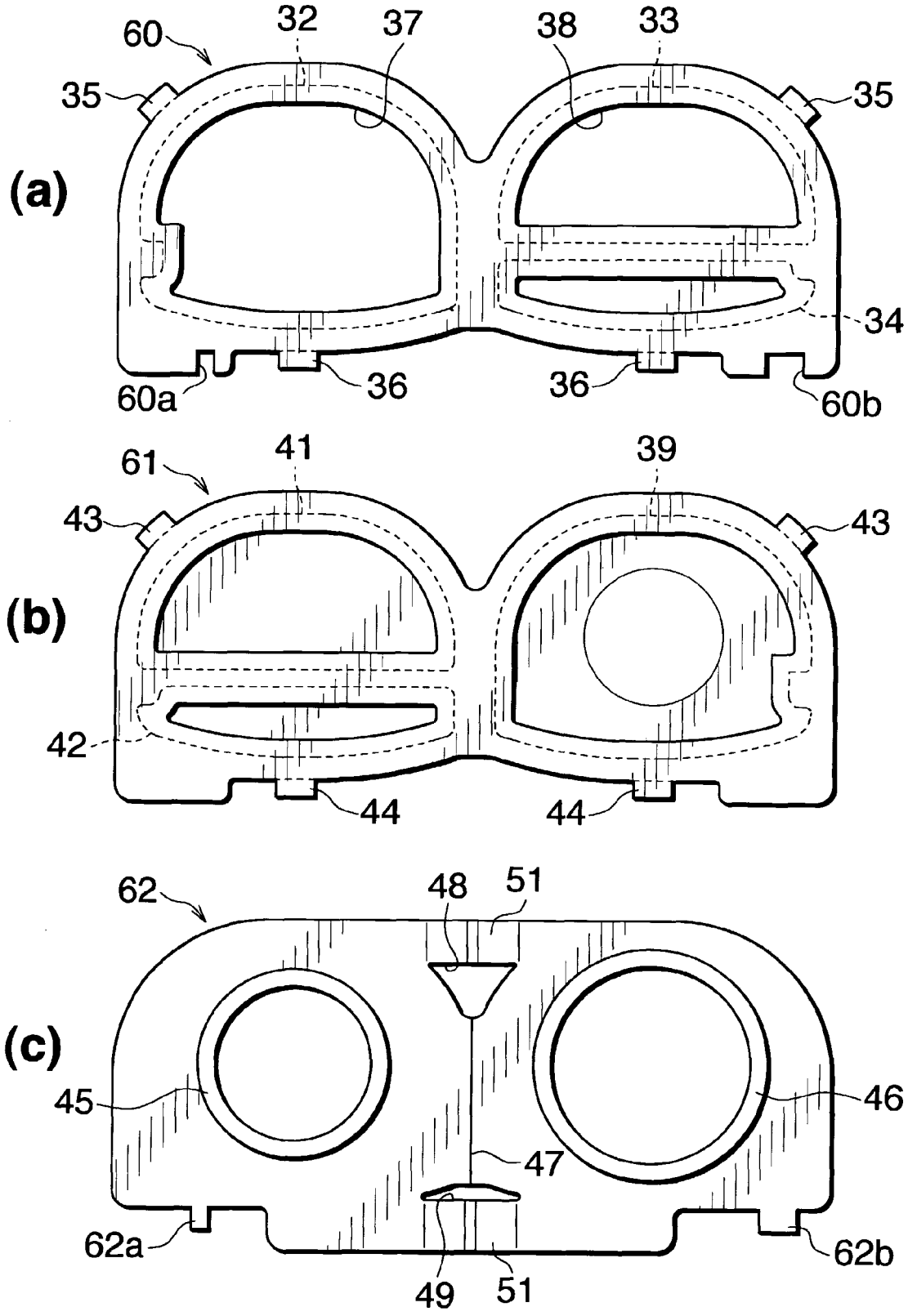
FIG. 13 is a front view showing the first and second caps and the pipe joint member of the evaporator of FIG. 11.

FIGS. 11 to 13 shows an evaporator (1A) in which a refrigerant inlet pipe (7) made of aluminum is connected to the left end portion of the refrigerant inlet header section (5) of the refrigerant inlet/outlet tank (2), and a refrigerant outlet pipe (8) made of aluminum is connected to the left end portion of the refrigerant outlet header section (6) of the refrigerant inlet/outlet tank (2). In the following description, members and portions similar to those shown in FIGS. 1 to 9 will be denoted by the same reference numerals.

In this evaporator (1A), a first cap (60), which is formed from an aluminum brazing sheet having a brazing material layer on each of opposite sides thereof and which closes the left end openings of the refrigerant inlet header section (5) and the refrigerant outlet header section (6), is brazed to the left ends of the two members (16) and (17) of the refrigerant inlet/outlet tank (2). A second cap (61), which is formed from an aluminum brazing sheet having a brazing material layer on each of opposite sides thereof and which closes the right end openings of the refrigerant inlet header section (5) and the refrigerant outlet header section (6), is brazed to the right ends of the two members (16) and (17). A pipe joint member (62) having a plate like shape and made of aluminum and elongated in the front-rear direction is brazed to the outer surface of the first cap (60) while bridging the refrigerant inlet header section (5) and the refrigerant outlet header section (6).

The first cap (60) has a shape which is a mirror image of that of the first cap (19) of the refrigerant inlet/outlet tank (2) of the evaporator (1) shown in FIGS. 1 to 9. The first cap (60) includes a first inwardly-projecting portion (32) to be fitted into the refrigerant inlet header section (5), a second inwardly-projecting portion (33) to be fitted into the upper space (6*a*) located above the flow-dividing resistance plate (29), a third inwardly-projecting portion (34) to be fitted into the lower space (6*b*) located under the flow-dividing resistance plate (29) and the upper and lower engagement fingers (35) and (36) projecting rightward. A refrigerant inlet (37) is formed on the projecting end wall of the first inwardly-projecting portion (32) and a refrigerant outlet (38) is formed on the projecting end wall of the second inwardly-projecting portion (33).

Cutouts (60*a*) and (60*b*) (mating concave portions) are formed with each of a front end portion and a rear end portion of the lower edge of the first cap (60), respectively. The distance between the cutout (60*a*) and the center of the first cap (60) with the respect of the front-rear direction differs from the distance between the cutout (60*b*) and the center of the first cap (60) with the respect of the front-rear direction. The cutout (60*a*) also differs in size from the cutout (60*b*). Moreover, the size of the front cutout (60*a*) and the distance between the cutout (60*a*) and the center of the first cap (60) with respect to the front-rear direction differ from the size of the rear cutout (19*b*) of the evaporator (1) and the distance between the cutout (19*b*) and the center of the first cap (19) thereof with respect to the front-rear direction, respectively; and the size of the rear cutout (60*b*) and the distance between the cutout (60*b*) and the center of the first cap (60) with respect to the front-rear direction differ from the size of the front cutout (19*a*) and the distance between the cutout (19*a*) and the center of the first cap (19) with respect to the front-rear direction, respectively. Consequently, the mating convex portion (21*a*) and (21*b*) of the pipe joint member (21) of the evaporator (1) shown in FIGS. 1 to 9 cannot fit into the cutouts (60*a*) and (60*b*) of the first cap (60). This configuration prevents erroneous attachment of the pipe joint member (21) to the first cap. (60) of the evaporator (1A).

The second cap (61) has a shape which is identical with that of the first cap (60) and which is a mirror image of the shape of the second cap (18) of the refrigerant inlet/outlet tank (2) of the evaporator (1) shown in FIGS. 1 to 9. The second cap (61) includes a first inwardly-projecting portion (39) to be fitted into the refrigerant inlet header section (5), a second inwardly-projecting portion (41) to be fitted into the upper space (6*a*) of the refrigerant outlet header section (6) located above the flow-dividing resistance plate (29), the third inwardly-projecting portion (42) which is fitted into the lower space (6*b*) of the refrigerant outlet header section (6) located under the flow-dividing resistance plate (29), and upper and lower engagement fingers (43) and (44) projecting leftward. The projecting end walls of the first and second inwardly-projecting portions (39) and (41) have no opening formed thereon. Further, the lower edge portion of the second cap (61) has no cutout as a mating concave portion formed thereon.

The pipe joint member (62) has a shape which is a mirror image of the shape of the pipe joint member (21) of the evaporator (1) shown in FIGS. 1 to 9. The pipe joint member (62) includes a short, cylindrical refrigerant inflow port (45) (refrigerant inflow portion) communicating with the refrigerant inlet (37) of the first cap (60), a short, cylindrical refrigerant outflow port (46) (refrigerant outflow portion) communicating with the refrigerant outlet (38) of the first cap (60), a slit (47), upper and lower through holes (48) and (49), and upper and lower bent portions (51).

Mating convex portions (62*a*) and (62*b*) which project rightward and are to be fitted into the cutouts (60*a*) and (60*b*) of the first cap (60) are formed integrally with front and rear end portions of the lower edge of the pipe joint member (62), respectively. The distance between the mating convex portion (62*a*) and the center of the pipe joint member (62) with respect to the front-rear direction differs from the distance between the mating convex portion (62*b*) and the center of the pipe joint member (62) with respect to the front-rear direction. The size of the mating convex portion (62*a*) differs from the size of the mating convex portion (62*b*). Moreover, the size of the front mating convex portion (62*a*) and the distance between the mating convex portion (62*a*) and the center of the pipe joint member (62) with respect to the front-rear direction differ from the size of the rear mating convex portion (21*b*) in the pipe joint member (21) of the evaporator (1) and the distance between the mating convex portion (21*b*) and the center of the pipe joint member (21) thereof with respect to the front-rear direction, respectively. The size of the rear mating convex portion (62*b*) and the distance between the mating convex portion (62*b*) and the center of the pipe joint member (62) with respect to the front-rear direction differ from the size of the front mating convex portion (21*a*) in the pipe joint member (21) and the distance between the mating convex portion (21*a*) and the center of the pipe joint member (21) with respect to the front-rear direction, respectively. Consequently, the pipe joint member (62) cannot be fitted into the cutouts (19*a*) and (19*b*) of the first cap (19) of the evaporator (1) shown in FIGS. 1 to 9, whereby erroneous attachment of the pipe joint member (62) to the first cap (19) of the evaporator (1) can be prevented.

The first and second members (16) and (17) of the refrigerant inlet/outlet tank (2), the two caps (60) and (61), and the pipe joint member (62) are brazed in a manner similar to that in the case of the evaporator (1) shown in FIGS. 1 to 9.

In the above-described embodiment, a single heat exchange tube group (13) is provided between the refrigerant inlet header section (5) and the refrigerant inflow header section (9) of the tanks (2) and (3), respectively, and a single heat exchange tube group (13) is provided between the refrigerant outlet header section (6) and the refrigerant outflow header section (11) of the tanks (2) and (3), respectively. However, the present invention is not limited thereto. For example, the following configuration may be employed: one or more heat exchange groups (13) are provided between the refrigerant inlet header section (5) and the refrigerant inflow header section (9) of the tanks (2) and (3), respectively; and one or more heat exchange groups (13) are provided between the refrigerant outlet header section (6) and the refrigerant outflow header section (11) of the tanks (2) and (3), respectively. Also, the refrigerant turn tank may be located above the refrigerant inlet/outlet tank.

In the above-described embodiment, the heat exchanger according to the present invention is applied to an evaporator. However, the present invention is not limited thereto. The present invention can be applied to other various heat exchangers.

INDUSTRIAL APPLICABILITY

The heat exchanger according to the present invention is preferably used as an evaporator of a car air conditioner, which is a refrigeration cycle mounted on an automobile.

The invention claimed is:

1. A heat exchanger comprising a refrigerant inlet header section and a refrigerant outlet header section which are arranged in parallel in a front-rear direction, and a refrigerant circulation passage for establishing communication between the header sections, wherein a refrigerant inlet is formed in the refrigerant inlet header section at a first end, and a refrigerant outlet is formed in the refrigerant outlet header section at the same end; and refrigerant having flowed from the refrigerant inlet into the refrigerant inlet header section returns to the refrigerant outlet header section after passing through the refrigerant circulation passage, and flows out of the refrigerant outlet, wherein the first ends of the refrigerant inlet header section and the refrigerant outlet header section are closed by a first cap joined to the two header sections while bridging them, and second ends of the refrigerant inlet header section and the refrigerant outlet header section are closed by a second cap joined to the two header sections while bridging them; the refrigerant inlet is formed in a portion of the first cap which closes the refrigerant inlet header section, and the refrigerant outlet is formed in a portion of the first cap which closes the refrigerant outlet header section; a pipe joint member having a refrigerant inflow portion communicating with the refrigerant inlet and a refrigerant outflow portion communicating with the refrigerant outlet is joined to the first cap; a mating concave portion is formed on the first cap, and a mating convex portion is formed on the pipe joint member such that the mating convex portion projects toward the first cap and is fitted into the mating concave portion; and the mating concave portion, into which the mating convex portion is fitted, is not formed on the second cap.

2. A heat exchanger according to claim 1, wherein the pipe joint member assumes a plate-like shape; and the first and second caps have the same outer shape, except for the mating concave portion.

3. A heat exchanger according to claim 1, wherein the mating concave portion is formed on the first cap at a position offset from the center thereof with respect to the front-rear direction.

4. A heat exchanger according to claim 1, wherein the mating concave portion comprises a cutout formed in a peripheral edge portion of the first cap.

5. A heat exchanger according to claim 1, wherein the refrigerant outlet header section is disposed on the rear side of the refrigerant inlet header section; the refrigerant circulation passage is formed by a refrigerant inflow intermediate header section disposed below the refrigerant inlet header section in opposition thereto, a refrigerant outflow intermediate header section disposed below the refrigerant outlet header section in opposition thereto, and a plurality of heat exchange tubes; the refrigerant inflow intermediate header section and the refrigerant outflow intermediate header section communicate with each other; at least one heat exchange tube group including a plurality of heat exchange tubes arranged at intervals along the longitudinal direction of the header sections is disposed between the refrigerant inlet header section and the refrigerant inflow intermediate header section and between the refrigerant outlet header section and the refrigerant outflow intermediate header section, whereby a heat exchanger core section is formed; and opposite end portions of the heat exchange tubes of the heat exchange tube group are connected to the opposed header sections.

* * * * *